US008084961B2

(12) United States Patent
Chao et al.

(10) Patent No.: US 8,084,961 B2
(45) Date of Patent: Dec. 27, 2011

(54) BACKLIGHT MODULE CONTROL SYSTEM AND CONTROL METHOD THEREOF

(75) Inventors: Han-Yu Chao, Taipei County (TW); Chien-Lung Tsou, Taoyuan County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 348 days.

(21) Appl. No.: 12/388,506

(22) Filed: Feb. 18, 2009

(65) Prior Publication Data

US 2010/0033100 A1 Feb. 11, 2010

(30) Foreign Application Priority Data

Aug. 6, 2008 (TW) ..... 97129881 A

(51) Int. Cl.
*G05F 1/00* (2006.01)
*H05B 37/02* (2006.01)

(52) U.S. Cl. ..... 315/307; 315/291

(58) Field of Classification Search ..... 315/307, 315/291, 224, 209 R, 312; 345/204, 80, 345/76, 77, 78
See application file for complete search history.

(56) References Cited

U.S. PATENT DOCUMENTS

| | | | | |
|---|---|---|---|---|
| 5,841,648 | A * | 11/1998 | Mansfield | 363/59 |
| 6,897,709 | B2 * | 5/2005 | Henry | 327/536 |
| 7,265,681 | B2 * | 9/2007 | Chen | 340/815.45 |
| 7,391,406 | B2 * | 6/2008 | Yamamoto et al. | 345/102 |
| 7,675,246 | B2 * | 3/2010 | Chiang et al. | 315/291 |
| 2006/0202637 | A1 * | 9/2006 | Chiang et al. | 315/291 |
| 2007/0273681 | A1 * | 11/2007 | Mayell | 345/211 |

* cited by examiner

*Primary Examiner* — Douglas W Owens
*Assistant Examiner* — Minh D A
(74) *Attorney, Agent, or Firm* — Winston Hsu; Scott Margo

(57) ABSTRACT

A backlight module control system includes at least one backlight module, a driving circuit, at least one switch and a power supply module. The driving circuit is utilized for determining a driving signal to drive the backlight module. The switch is coupled between the driving circuit and the backlight module, and is selectively turned on or off according to the driving signal. The power supply module is coupled to the backlight module, and is utilized for providing an operating voltage required by the backlight module control system.

8 Claims, 6 Drawing Sheets

BACKLIGHT MODULE CONTROL SYSTEM AND CONTROL METHOD THEREOF

BACKGROUND OF THE INVENTION

1. Field of the Invention

The present invention relates to a backlight module control system, and more particularly, to a light-emitting diode (LED) backlight module control system and a control method thereof.

2. Description of the Prior Art

Please refer to FIG. 1. FIG. 1 is a diagram illustrating a prior art backlight module control system 100. The backlight module control system 100 includes a driving circuit 110, an LED module 120, a feedback compensation circuit 130 and a DC/DC converter 140. In addition, the driving circuit 110 includes a plurality of current sources 112 and a plurality of switches 114 respectively corresponding to the current sources 112. The LED module 120 includes a plurality of LED sub-modules 122 where each LED sub-module 122 includes a plurality of LEDs connected in series. With reference to FIG. 1, operations of the backlight module control system 100 are described as follows:

First, the switches 114 are selectively turned on or off according to a pulse width modulation (PWM) signal to generate a driving signal, and the LED sub-modules 122 are enabled or disabled according to the driving signal. When the switches 114 are turned on (i.e., the LED sub-modules 122 are enabled), the feedback compensation circuit 130 gets voltage values of nodes $V_{m1}, V_{m2}, V_{m3}, \ldots, V_{mn}$ and provides a compensation value to the DC/DC converter 140. Then, the DC/DC converter 140 outputs an operating voltage $V_{LED}$ required by the backlight module control system 100 according to the compensation value.

When the switches 114 are turned off (i.e., the LED sub-modules 122 are disabled), because a capacitance of each LED sub-module 122 is greater than a capacitance between each node ($V_{m1}, V_{m2}, V_{m3}, \ldots, V_{mn}$) and ground, the voltage levels of the nodes $V_{m1}, V_{m2}, V_{m3}, \ldots, V_{mn}$ approach the operating voltage $V_{LED}$.

In general, current controls of the current sources 112 are implemented by current sinks. In other words, a current of each LED sub-module 122 is controlled by current mirrors of the driving circuit 110. In addition, in order to lower the power consumption and increase the driving ability, most of the driving circuits using the current sinks have lower withstand voltages (about 60 volts). As described above, the voltage levels of the nodes $V_{m1}, V_{m2}, V_{m3}, \ldots, V_{mn}$ approach the operating voltage $V_{LED}$ when the LED sub-modules 122 are disabled, therefore, the operating voltage $V_{LED}$ cannot be designed to be greater than the withstand voltage of the driving circuit 110. Therefore, a quantity of the LEDs included in each LED sub-module 122 is limited. For a large size display panel requiring many LEDs, more driving circuits 100 of the backlight module are needed and the cost is thereby increased.

SUMMARY OF THE INVENTION

It is therefore an objective of the present invention to provide a backlight module control system and a control method thereof, to ensure that when the backlight module control system uses a driving circuit having a lower withstand voltage, the system can use a higher operating voltage to drive the LEDs connected in series without damaging the driving circuit.

According to one embodiment of the present invention, a backlight module control system comprises at least one backlight module, a driving circuit, at least one switch and a power supply module. The driving circuit is utilized for determining a driving signal to drive the backlight module. The switch is coupled between the driving circuit and the backlight module, and is turned on or off according to the driving signal. The power supply module is coupled to the backlight module, and is utilized for providing an operating voltage required by the backlight module control system.

According to another embodiment of the present invention, a method for controlling a backlight module control system comprises: providing a driving circuit to determine a driving signal to drive at least one backlight module in the backlight module control system; selectively connecting the backlight module to the driving circuit according to the driving signal, in order to respectively enable or disable the backlight module; and providing an operating voltage required by the backlight module control system.

According to the backlight module control system and the control method thereof, when the LED sub-module of the LED module (i.e., backlight module) is disabled, an output node of the driving circuit will not be close to the operating voltage of the backlight module control system, and the backlight module control system can therefore use a higher operating voltage to drive more LEDs. For a large size display panel requiring many LEDs, quantity of driving circuits of the backlight module is thereby reduced and the cost is decreased.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
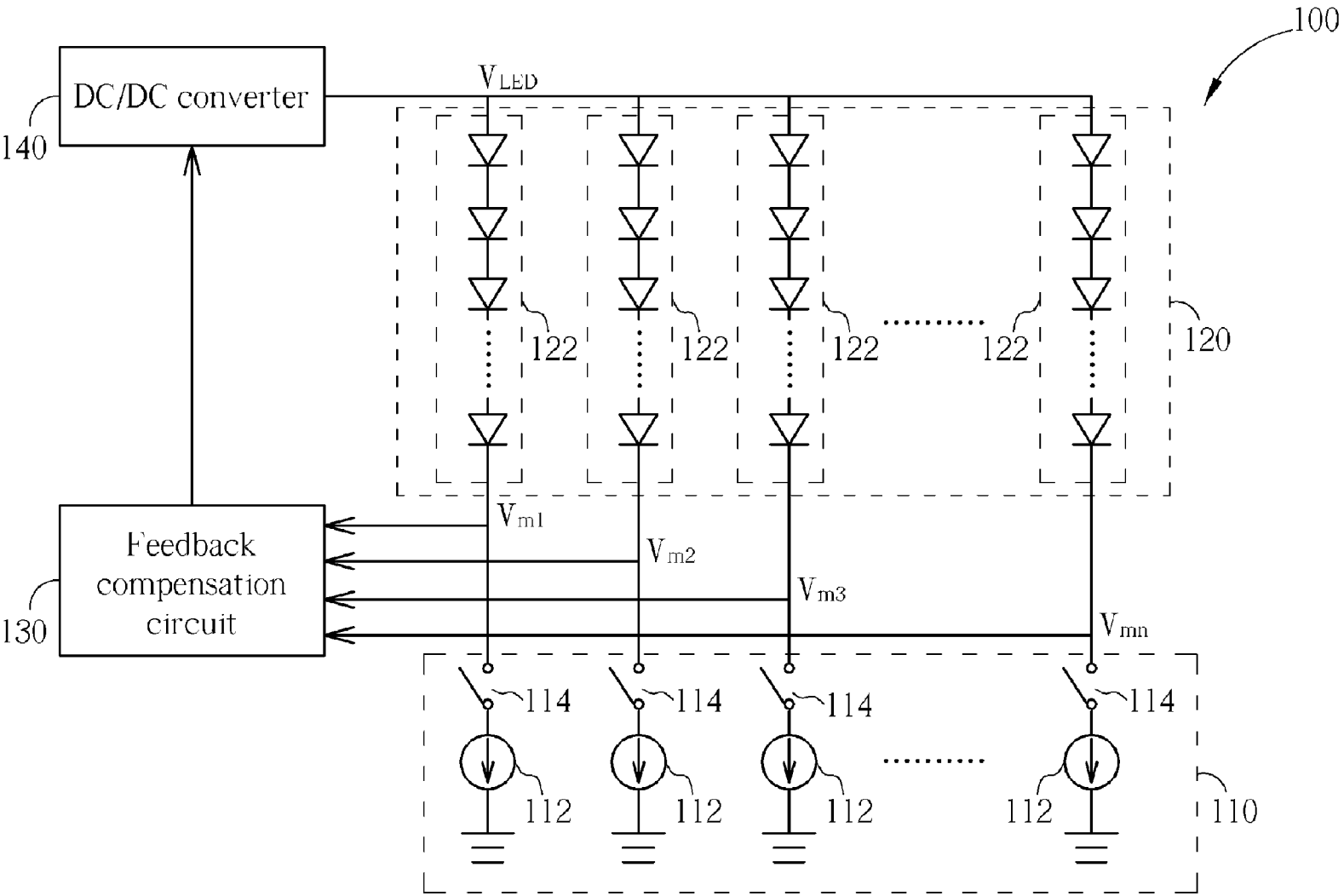
FIG. 1 PRIOR ART
FIG. 1 is a diagram illustrating a prior art backlight module control system.
Figure 2:
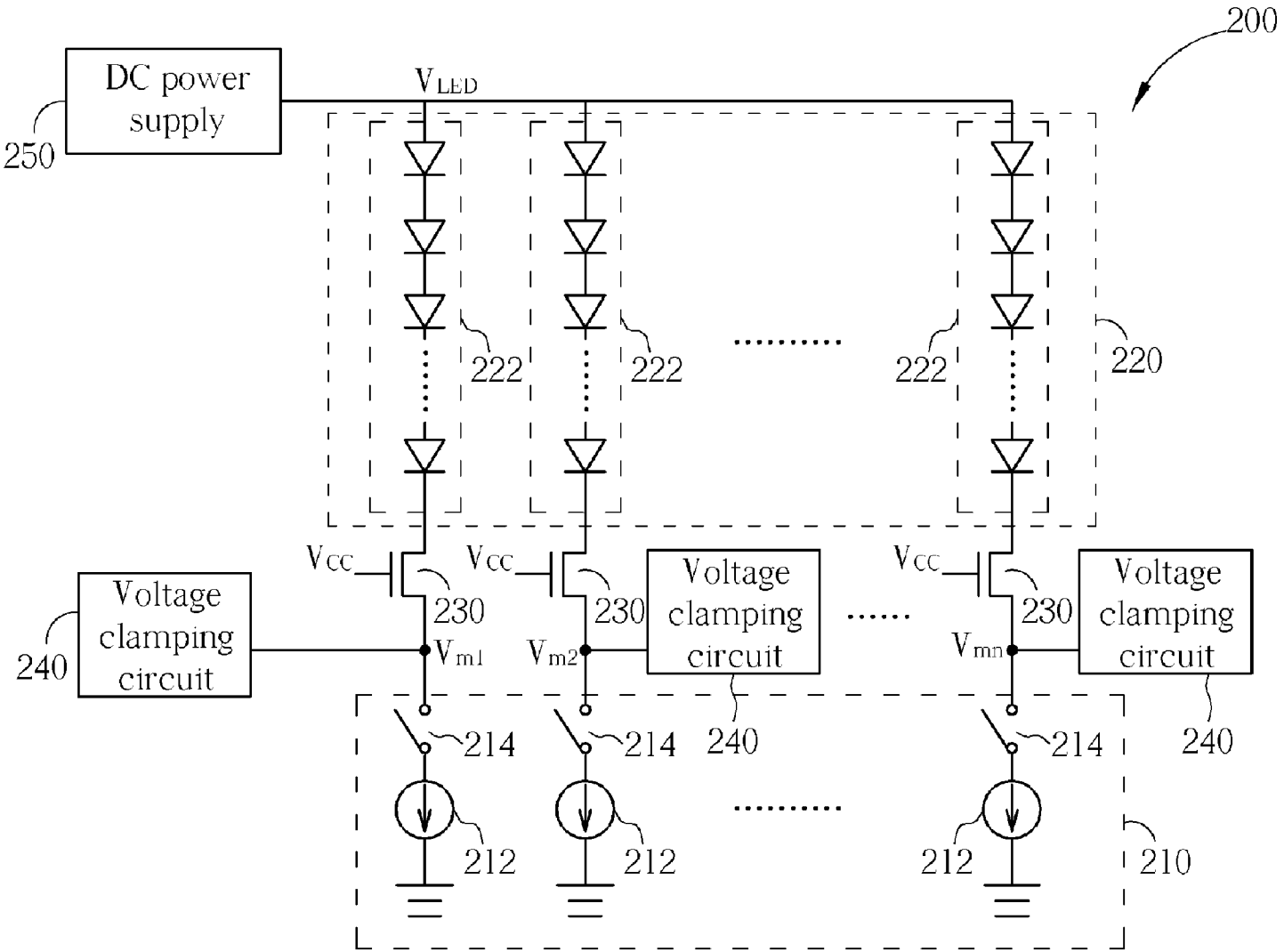
FIG. 2 is a diagram illustrating a backlight module control system according to one embodiment of the present invention.

Please refer to FIG. 2. FIG. 2 is a diagram illustrating a backlight module control system 200 according to one embodiment of the present invention. The backlight module control system 200 includes (but is not limited to) a driving circuit 210, an LED module 220, a plurality of first switches 230, a plurality of voltage clamping circuits 240 and a DC power supply 250. The DC power supply 250 serves as a power supply module and is used to provide an operating voltage $V_{LED}$ required by the backlight module control system 200. Each first switch 230 is implemented by an NMOS (N-type Metal-Oxide Semiconductor), and a voltage of a gate electrode is about 3.3V-5V. In addition, the driving circuit 210 includes a plurality of current sources 212 and a plurality of second switches 214 respectively corresponding to the current sources 212, where the current sources 212 are implemented by current sinks. The LED module 220 includes a plurality of LED sub-modules 222, and each LED sub-module 222 includes a plurality of LEDs connected in series.

In the operations of the backlight module control system 200, the second switches 214 are turned on or off according to a PWM (Pulse Width Modulation) signal to generate driving signals, and the LED sub-modules 222 are enabled or disabled according to the driving signals, respectively. When the second switches 214 are turned on (i.e., the LED sub-modules 222 are enabled), the voltage clamping circuits 240 clamp the nodes $V_{m1}, V_{m2}, \ldots, V_{mn}$ at ground voltages which are far less than a withstand voltage of the driving circuit 210. In addition, for each first switch 230, because a voltage difference between a gate electrode of the first switch 230 and each node ($V_{m1}, V_{m2}, \ldots, V_{mn}$) is greater than a threshold voltage $V_{th}$ of the first switch 230, the first switch 230 is therefore turned on.

Then, at a time when the second switches 214 are turned off, the first switches 230 are still turned on, and the voltages of the nodes $V_{m1}, V_{m2}, \ldots, V_{mn}$ gradually increase until the voltage differences between the gate electrodes of the first switches 230 and each node $V_{m1}, V_{m2}, \ldots, V_{mn}$ is less than the threshold voltages $V_{th}$ of the first switches 230 (at this time, the first switches 230 are turned off). In addition, because the gate electrodes of the first switches 230 are supplied by a voltage $V_{CC}$ about 3.3V-5V, therefore, maximum voltages of the nodes $V_{m1}, V_{m2}, \ldots, V_{mn}$ are (5-$V_{th}$), which is far less than the withstand voltage of a conventional driving circuit (e.g., 30V). As mentioned above, voltages of the output nodes $V_{m1}$, $V_{m2}, \ldots, V_{mn}$ of the driving circuit 210 are irrelevant to the operating voltage $V_{LED}$. Therefore, the backlight module control system 200 can utilize a higher operating voltage $V_{LED}$ to drive more LEDs; i.e. each LED sub-module 222 can include more LEDs. Quantity of the driving circuit 210 can therefore be reduced, and the cost is decreased.

It is noted that, in the backlight module control system 200 of the present invention, the first switches 230 being implemented by NMOS and their gate electrodes being supplied by the voltage $V_{CC}$ at about 3.3V-5V is merely for exemplary purposes. In practice, as long as it can be ensured that, when the second switches 214 are turned on, the first switches 230 are also turned on, and ensured that the voltages of the nodes $V_{m1}, V_{m2}, \ldots, V_{mn}$ do not exceed the withstand voltage of the driving circuit 210 when the second switches 214 are turned off, the voltage $V_{CC}$ can be designed according to the designer's considerations. In addition, the circuit structure shown in FIG. 2 is for illustrative purposes only, and is not meant to be a limitation of the present invention. For example, if the results are substantially the same, in other embodiments of the present invention, the first switches 230 can be implemented by other type of transistors. These alternative designs all fall within the scope of the present invention.

Figure 3:
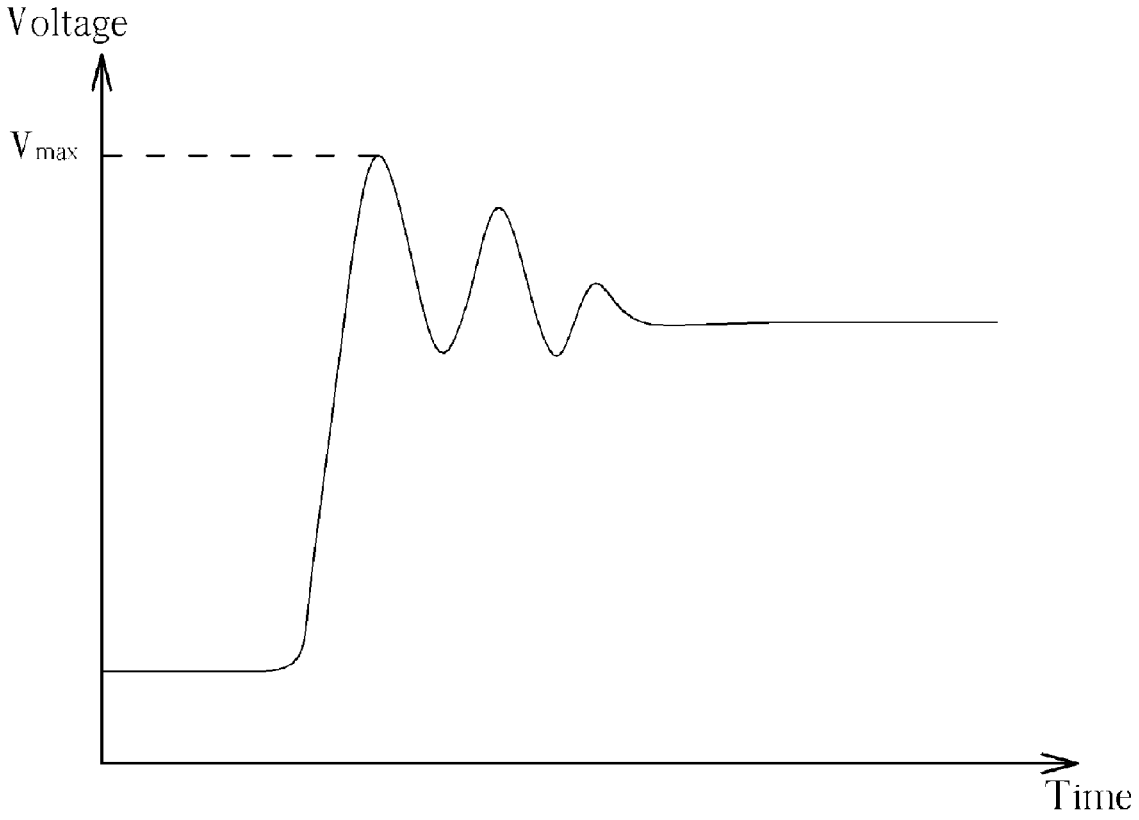
FIG. 3 is a timing diagram illustrating voltages of nodes Vm1, Vm2, . . . , Vmn shown in FIG. 2.
Figure 4:
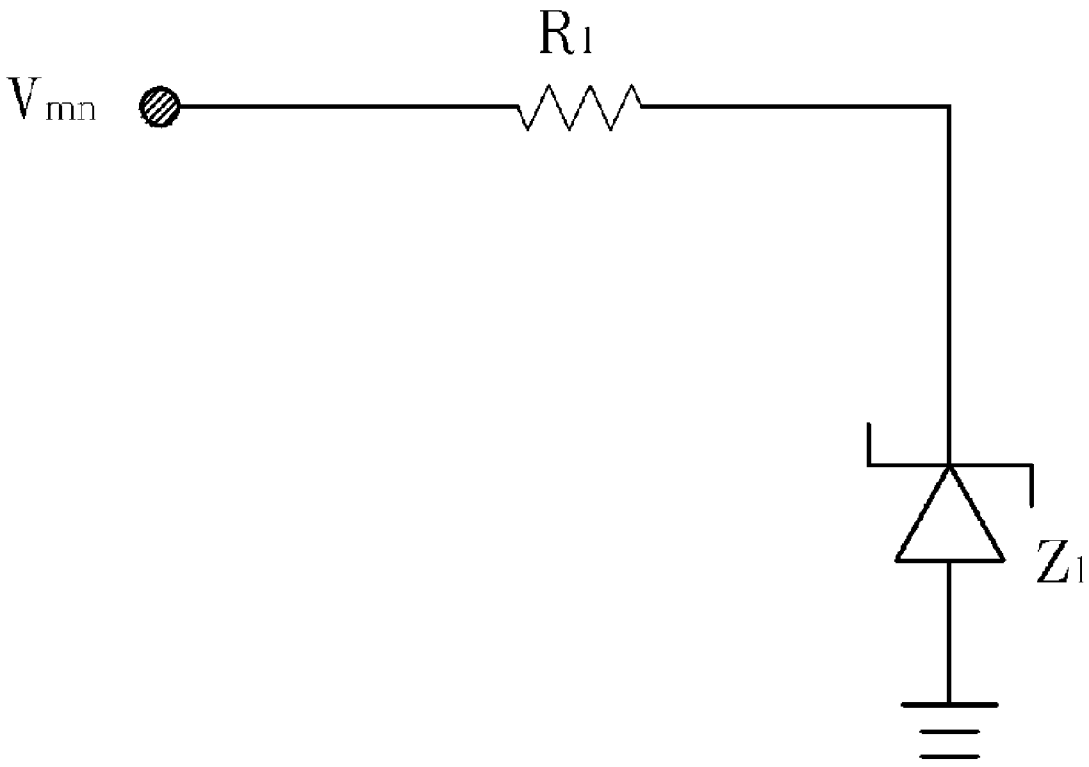
FIG. 4 illustrates a circuit diagram according to a first embodiment of the voltage clamping circuit shown in FIG. 2.
Figure 5:
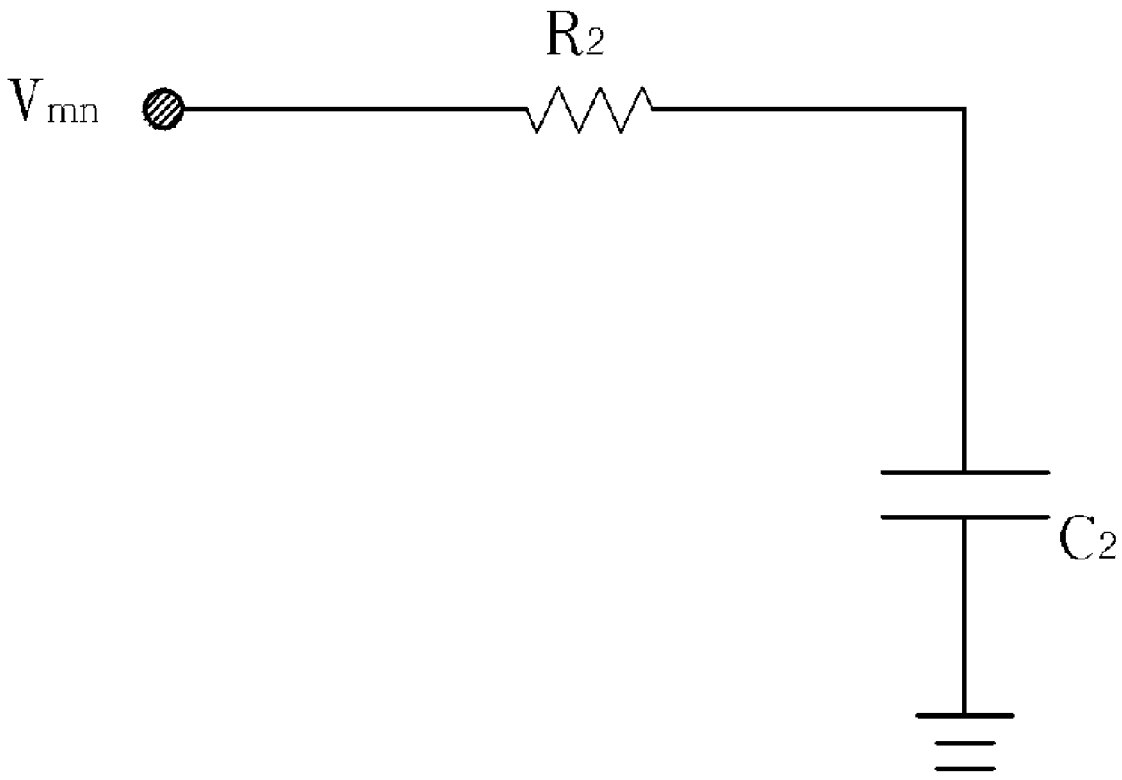
FIG. 5 illustrates a circuit diagram according to a second embodiment of the voltage clamping circuit shown in FIG. 2.
Figure 6:
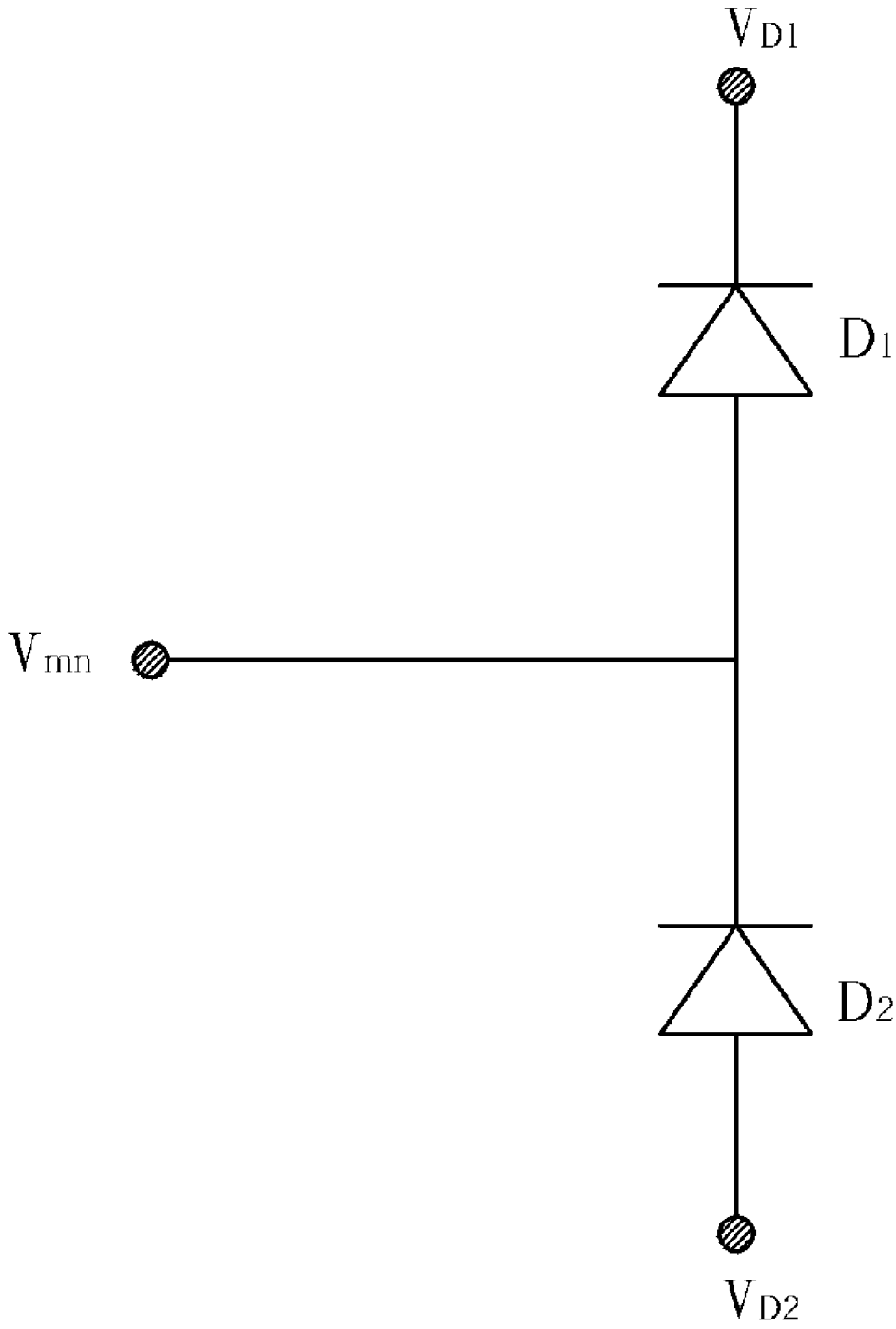
FIG. 6 illustrates a circuit diagram according to a third embodiment of the voltage clamping circuit shown in FIG. 2.

In addition, during the period when the voltages of the nodes $V_{m1}, V_{m2}, \ldots, V_{mn}$ gradually increase as described above, "ripple voltages" shown in FIG. 3 appear at the nodes $V_{m1}, V_{m2}, \ldots, V_{mn}$. At this time, the voltage clamping circuits 240 has a snubber function, and can prevent maximum voltages $V_{max}$ (shown in FIG. 3) of the nodes from exceeding the withstand voltage of the driving circuit 210 due to the "ripple voltage" phenomenon. FIGS. 4-6 illustrate circuit diagrams according to three embodiments of the voltage clamping circuit 240 shown in FIG. 2. In FIG. 4, the voltage clamping circuit 240 includes a resistor $R_1$ and a Zener diode $Z_1$ connected in series. In FIG. 5, the voltage clamping circuit 240 includes a resistor $R_2$ and a capacitor $C_2$ connected in series, where the voltage clamping circuit 240 shown in FIG. 4 and FIG. 5 can smooth the "ripple voltage" phenomenon. In FIG. 6, the voltage clamping circuit 240 includes two diodes $D_1$ and $D_2$ respectively connected to two supply voltages $V_{D1}$ and $V_{D2}$, and the voltages of the nodes $V_{m1}, V_{m2}, \ldots, V_{mn}$ are clamped between voltages $V_{D1}$ and $V_{D2}$.

Briefly summarizing the backlight module control system and the control method thereof, first, a driving circuit generates a driving signal according to a PWM signal to drive the backlight module control system. Then, a first switch is selectively turned on or off according to the driving circuit, wherein when the first switch is turned off, voltages of output nodes of the driving circuit are far less than an operating voltage of the backlight module control system. In conclusion, the backlight module control system can use a higher operating voltage so that more LEDs can be connected in series. Quantity of the driving circuit is therefore reduced, and the cost is decreased.

Those skilled in the art will readily observe that numerous modifications and alterations of the device and method may be made while retaining the teachings of the invention.

What is claimed is:

1. A backlight module control system, comprising:

at least one backlight module;

a driving circuit, for determining a driving signal to drive the backlight module;

at least one first switch, having a first node, a second node and a control node and coupled between the driving circuit and the backlight module, for being selectively turned on or off according to the driving signal inputted into the control node of the first switch; and a power supply module, coupled to the backlight module, for providing an operating voltage required by the backlight module control system;

wherein the driving circuit comprises:

a current source, for providing a current to the backlight module; and at least one second switch, coupled between the current source and the first switch, for being selectively turned on or off according to a pulse width modulation (PWM) signal to determine the driving signal; wherein a first terminal of the current source is connected to the second switch and a second terminal of the current source is connected to a ground;

wherein the first node of the first switch is coupled to the backlight module, the second node of the first switch is connected to the second switch, and the second switch is coupled to the backlight module only when the first switch is in a conducting state.

2. The backlight module control system of claim 1, wherein the backlight module is a light emitting diode (LED) backlight module including at least one LED.

3. The backlight module control system of claim 1, further comprising:

at least one voltage clamping circuit, coupled to the first switch and the driving circuit, for clamping a voltage of an output node of the driving circuit.

4. The backlight module control system of claim 1, wherein when the second switch is turned on, the first switch is turned on; and when the second switch is turned off, the first switch is turned off.

5. A control method of the backlight module control system, comprising:

providing a current source;

providing at least a first switch having a first node, a second node and a control node, where the first switch is selectively turned on or off according to a driving signal inputted into the control node of the first switch;

providing at least a second switch coupled between the first switch and the current source utilizing the second switch to selectively couple the current source to at least one backlight module or not according to a PWM signal to determine the driving signal;

utilizing the first switch to selectively couple the backlight module to the current source or not according to the driving signal to enable or disable the backlight module; wherein a first terminal of the current source is connected to the second switch and a second terminal of the current source is connected to a ground; and providing an operating voltage required by the backlight module control system;

wherein the first node of the first switch is coupled to the backlight module, the second node of the first switch is connected to the second switch, and the second switch is coupled to the backlight module only when the first switch is in a conducting state.

6. The control method of claim 5, wherein the backlight module is an LED backlight module including at least one LED.

7. The control method of claim 5, further comprising:

clamping a voltage of an output node of the driving circuit.

8. The control method of claim 5, wherein when the current source is coupled to the backlight module according to the PWM signal, the backlight module is coupled to the driving circuit according to the driving signal; and when the current source is not coupled to the backlight module according to the PWM signal, the backlight module is not coupled to the driving circuit according to the driving signal.

* * * * *